United States Patent [19]

Rose et al.

[11] 4,379,666

[45] Apr. 12, 1983

[54] APPARATUS FOR MANUFACTURE OF JIGS

[75] Inventors: John A. Rose, Knaresborough; Keith Dyer, Leeds, both of England

[73] Assignee: AMF Incorporated, White Plains, N.Y.

[21] Appl. No.: 187,291

[22] Filed: Sep. 15, 1980

[30] Foreign Application Priority Data

Sep. 19, 1979 [GB] United Kingdom ..... 7932472

[51] Int. Cl.[3] ..... B23C 1/16

[52] U.S. Cl. ..... 409/110; 409/111

[58] Field of Search ..... 409/110, 111, 114, 113

[56] References Cited

U.S. PATENT DOCUMENTS

| | | | |
|---|---|---|---|
| 554,333 | 2/1896 | Cook | 409/110 |
| 2,693,737 | 11/1954 | Smith | 409/110 |
| 2,896,511 | 7/1959 | Seeberg | 409/110 |
| 3,541,922 | 11/1970 | Laure | 409/110 |
| 3,860,050 | 1/1975 | Banks | 409/110 X |

*Primary Examiner*—Leon Gilden

*Attorney, Agent, or Firm*—David E. Dougherty; Charles J. Worth

[57] ABSTRACT

In the formation of the components of a jig for profile stitching of garment parts, a profile formed in one component is used to create associated profiles in a second component and subsequently one of the associated profiles of the second component is used to create a related profile in the first component.

6 Claims, 4 Drawing Figures

APPARATUS FOR MANUFACTURE OF JIGS

The invention relates to a method of and apparatus for use in the manufacture of a profile sewing jig of the type, known in the clothing manufacturing trade and hereinafter referred to as a jig of the type aforesaid, comprising a top plate peripherally shaped according to a desired sewing profile to be executed thereby and hingedly mounted for face-to-face contact with a bottom plate having a slot of constant width and a peripheral edge both shaped according to the said desired profile. Frequently it is required that the top plate be provided with an aperture, filled by a separate matching fulling plate, both the aperture and the fulling plate being shaped according to said desired profile.

Conventionally jigs of the type aforesaid have been manufactured by independently forming and subsequently assembling the several component parts thereof and the use of a machine tool and much skill is required. It is therefore an object of the invention to simplify the manufacture of such jigs.

According to one aspect of the invention there is provided a method of use in the manufacture of jigs of the type aforesaid comprising mounting top plate means in predetermined spacial relationship with a sheet of bottom plate material, said top plate means being formed from a sheet of top plate material so that at least a portion of the periphery thereof is shaped according to the desired sewing profile, following said portion of the periphery of the top plate means by feeler means operatively connected to forming means whereby said forming means are guided to form in said sheet of bottom plate material contours including the slot and the outer peripheral edge of the bottom plate.

When it is required that the top plate be provided with an aperture to be occupied by a fulling plate, the method may further comprise mounting a portion of the sheet of bottom plate material having at least one of said contours in predetermined spacial relationship with, in turn, the top plate means and a sheet of fulling plate material, following said at least one contour of the portion of the sheet of bottom plate material by feeler means operatively connected to forming means whereby said forming means are guided to form, respectively in the top plate means and the sheet of fulling plate material, said aperture and at least a portion of the periphery of the fulling plate.

Preferably the contour followed by the feeler means is an internal contour and preferably again the contour is the one which defines the outer edge of the slot.

Preferably said predetermined spacial relationships obtain when the respective sheets are in parallel planes and the said portion of the periphery of the top plate means occupies the same position in those planes relative to the slot of the bottom plate and the outer periphery of the fulling plate, respectively, that they are intended to occupy in the assembled jig.

According to a further aspect of the invention there is provided apparatus for use in the manufacture of jigs of the type aforesaid, comprising means for mounting top plate means in predetermined spacial relationship with a sheet of bottom plate material, forming means for forming contours in said sheet of bottom plate material, feeler means arranged for following at least a portion of the periphery of said top plate means and operatively connected to said forming means whereby contours including the slot and the outer peripheral edge of the bottom plate may be formed.

Preferably the feeler means comprises a feeler member for guiding the forming means to form each of said slot and said peripheral edge of the bottom plate. The forming means may be such as to form the opposed edges of the slot simultaneously.

According to yet a further aspect of the invention there is provided apparatus for use in the manufacture of jigs of the type aforesaid in which the top plate means is provided with an aperture to be occupied by a fulling plate, the apparatus comprising means for mounting a portion of the sheet of bottom plate material having at least one of said contours in predetermined spacial relationship with either or, in turn, both the top plate means and a sheet of fulling plate material, forming means for forming said top plate means and said sheet of fulling plate material, feeler means arranged for following said at least one said contour and operatively connected to said forming means whereby the forming means may form, in turn, at least one edge of said aperture and at least one edge of said fulling plate.

Preferably the mounting means may comprise spacing means whereby said sheet may be arranged in parallel planes. Forming means may comprise a routing cutter mounted for rotation about an axis perpendicular to said planes, and the feeler means may comprise a cylinder or cylinders mounted coaxially with said routing cutter and spaced axially from the routing cutter by a distance corresponding to the distance between said planes.

Embodiments of the invention will now be described by way of example and with reference to the accompanying drawings of which:

Figure 1:
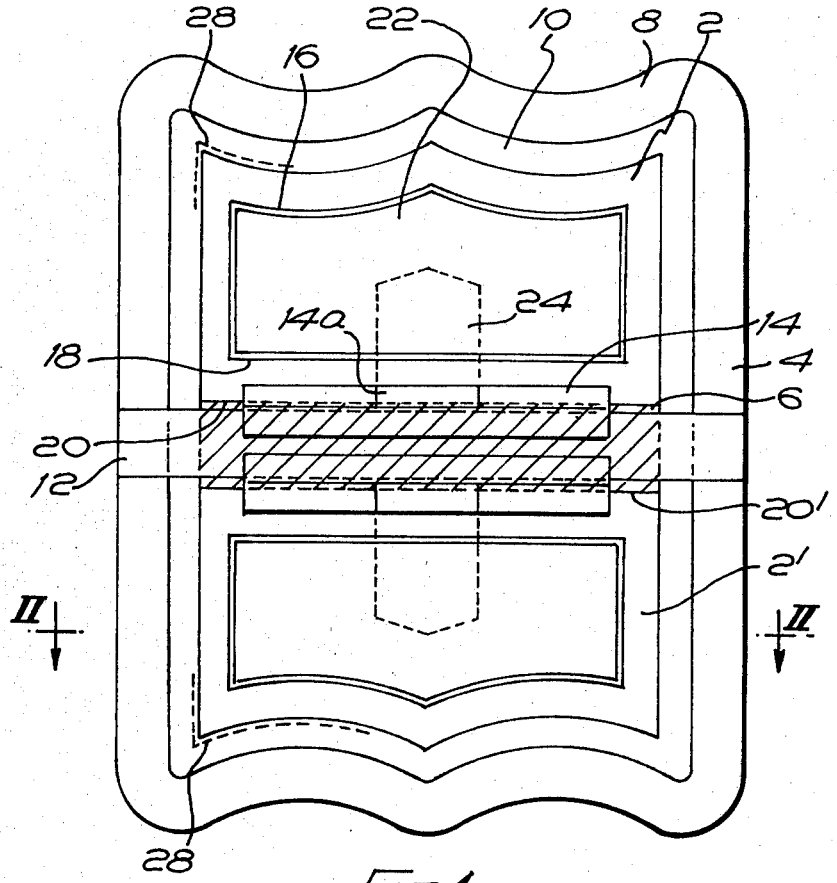
FIG. 1 is a plan view of a profile sewing jig of the type aforesaid.

As shown in FIG. 1, the jig comprises top plates 2, 2' in face-to-face relationship with a bottom plate 4 which in turn comprises an inner portion 6 and an outer portion 8, the outer and inner portions being separated by a slot 10 of constant width. The outer and inner portions are retained in their respective positions by means of a bridge 12.

Each top plate 2, of which the outer periphery coincides at three sides with the outer periphery of the inner portion 6 of bottom plate 4, is pivotally mounted on bridge 12 by hinge 14 so that it can be raised for the loading of a garment panel or the like on to the upper face of inner portion 6 of the bottom plate against which it is subsequently clamped by the returning of the top plate to the horizontal position.

Each top plate may be, and in the embodiment illustrated is, provided with an aperture 16 of which the edges are equidistant from the said three sides of the outer periphery; the fourth edge 18 of the aperture is parallel to but more distantly spaced from the fourth edge 20 of the outer periphery of the top plate.

The aperture 16 is filled with a fulling plate 22 formed from sheet material thicker than the top plate but of substantially similar shape to that of the aperture, and it is connected to a separate portion **14*a* of hinge 14 by means of a strap 24 which passes underneath the top plate 2**.

Figure 2:
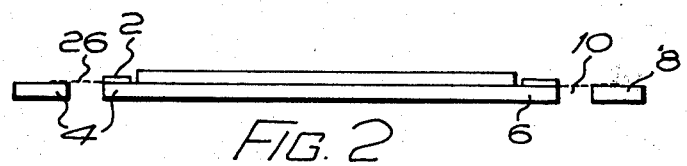
FIG. 2 is a section on line II—II of FIG. 1.

In use of the jig with, normally, two face-to-face garment panels clamped between the bottom plate portion 6 and each top plate 2 and extending across the slot 10 as shown by dotted line 26 in FIG. 2, the jig is loaded into a sewing machine and guided by means following the slot 10 so that a stitch line is formed in that portion of the panels overlying the slot 10 at an accurately predetermined distance from the three sides of the periphery of each top plate 2, 2', as shown in dotted lines 28 in FIG. 1.

In carrying out the method of the invention, a top plate blank 40, which may be of sheet aluminium, is first cut or otherwise formed in a shape corresponding to that of top plates 2, 2' together with the intermediate shaded portion shown in FIG. 1 from which the two top plates can later be cut by cutting along straight edges 20, 20' and disposing of the intermediate rectangle corresponding to the shaded area of FIG. 1. The outer periphery of blank 40 is such as to represent the locus of points lying at a pre-determined distance from the desired stitch lines 28 in a direction normal to the stitch lines. Between the end of the stitch line of one panel and the corresponding end of the stitch line of the other panel the edge of the blank is preferably rectilinear.

Figure 3:
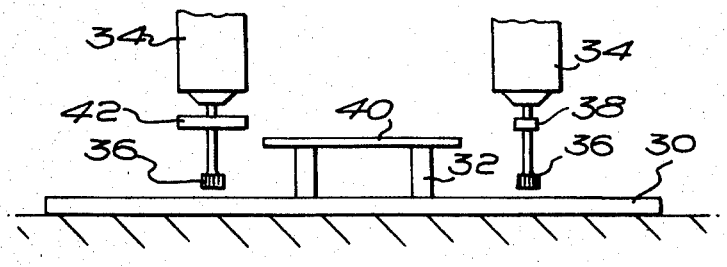
FIG. 3 is a side elevation of apparatus for cutting some of the components of the jig of FIG. 1.
Figure 4:
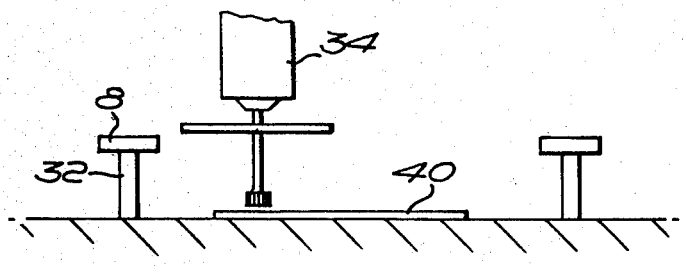
FIG. 4 is a side elevation of apparatus for cutting other components of the apparatus of FIG. 1.

FIG. 3 illustrates the manufacture of the two portions of the bottom plate from a sheet of material 30 secured to a horizontal table by means located both in the outer portion 8 and the inner portion 6 without encroaching on the area of the slot 10. The top plate blank 40 is supported on spacers 32 parallel to sheet 30.

A router 34 is mounted so that the cutting tool 36 can be moved freely over the area of the sheet 30 whilst retaining the axis of the cutter vertical. A disc 38 is mounted on the shaft of the routing cutter at a distance from the tool 36 corresponding to the height of the spacers 32 so that with the cutter lowered so that the tool 36 cuts the sheet 30, the outer periphery of top plate blank 40 can be followed by the edge of disc 38 acting as a feeler. The diameter of the cutting tool 36 is such that in one pass it cuts a track in the sheet 30 of width corresponding to that of the slot 10, and the disc 38 is of similar diameter so that by following the outer peripheral edge of top plate blank 40 the whole of the slot 10 can be formed.

Using a different but similar tool or, preferably, the same tool but with the substitution of disc 38 by disc 42 of larger diameter, the peripheral edge of blank 40 is again followed by the disc acting as a feeler with the routing cutter now forming the outer peripheral edge of outer portion 8 of the bottom plate 4, the width of the outer portion 8 being a constant value dictated by the diameter of the disc 42.

The inner portion 6 of bottom plate 4 is removed from the table, the blank 40 is secured directly to the table and the outer portion 8 of the bottom plate 4 is raised to the level of blank 40 shown in FIG. 3, the relative positions of the blank 40 and the outer portion 8 in the horizontal plane being maintained as it was in the first cutting stage.

With a cutting tool and feeler disc each of appropriate diameter fitted to router 34, the inner edge of the outer portion 8 is followed by the disc so that the tool cuts at each end of the blank three sides of the aperture 16, that is to say the whole of the aperture apart from edge 18. Edge 18 at each side of the blank may be cut with the same tool, the feeler disc being guided by a straight edge located transversely of the outer portion 8. In forming the shape shown in FIG. 1, the extreme corners of the aperture 16 may be formed with too large radii and the apertures may require subsequent trimming. The blank 40 is removed from the table, the corners of the apertures trimmed if necessary and the plate cut along edges 20 to form the two top plates 2, 2' with the rejection of the intermediate rectangle. A piece of sheet material is placed on the table in the space left by the removal of the blank and the routing cutter is applied to cut the sheet material to form three sides of the fulling plate 22.

The diameter of the feeler disc will, of course, be chosen according to the diameter of the cutting tool, bearing in mind that it is the outer edge of the cut which substantially defines the required profile of the aperture, whilst it is the inner edge of the cut which defines the corresponding profile of the fulling plate.

It will be understood that in each pass of a cutting tool through a sheet of material a slot of width according to the diameter of the tool is formed unless the sheet is larger than the shape to be formed by a margin less than the diameter of the cutting tool in which case the cutting tool merely trims the sheet to the required shape rather than forms a slot; only in the case of the cutting of the slot 10 are both edges of the slot required. The straight edge referred to in connection with the cutting of edge 18 of the aperture 16 will be used to cut the rear edge of the fulling plate.

It is appropriate at this point to indicate that if in the formation of the bottom plate a sheet of bottom plate material of sufficient size is employed so that the formation in that sheet of the outer peripheral edge of the outer portion 8 is effected by creating a complete slot therein, the outer edge of that slot will effectively have a similar shape to the outer edge of slot 10. It may therefore be possible and it is within the scope of the invention in the formation of the fulling plate and fulling aperture to substitute for the outer portion of the bottom plate the otherwise waste portion of the sheet of bottom plate material and following with a feeler disc the inner edge thereof which, as indicated above, has a shape similar to that of the outer edge of slot 10.

The individual component parts of the jig of FIG. 1 having been thus formed, the jig may be assembled in the conventional manner. It will be appreciated that jigs of other shape may be formed in a similar way. Whilst the jig shown in FIG. 1 is a double jig having two similar top plates, the method of the invention can be applied to the production of components for a single jig having but one top plate.

We claim:

1. Apparatus for the manufacture of multiple plate jigs for use in sewing, comprising a top plate with a contoured outer periphery;

mounting means adapted to removably support in predetermined spatial relationship a work piece of bottom plate material and said top plate above and parallel to the work piece;

forming means for contouring a work piece to form a bottom plate with a contoured periphery and for forming a contoured slot thereby separating the bottom plate into inner and outer portions:

a pair of feeler means each being arranged to move independent of the other along the periphery of said top plate;

one of said feeler means being operatively connected to guide said forming means when contouring the outer periphery of a bottom plate; and the other of said feeler means being operatively connected to guide said forming means when forming a contoured slot in a bottom plate.

2. The apparatus in accordance with claim 1, wherein said forming means comprising a routing cutter rotatably driven on an axis perpendicular to the work piece.

3. The apparatus in accordance with claim 2, and said routing cutter being of a predetermined size to simultaneously form the opposed contoured edges of the slot.

4. The apparatus in accordance with claim 1, and said mounting means being adapted to removably support in predetermined spatial relationship said top plate as a work piece and the outer portion of a bottom plate above and parallel to said work piece;

said forming means forming an aperture in said top plate; and a third feeler means arranged to move along a contoured periphery of the outer portion of a bottom plate and being connected to guide said forming means when forming the aperture in the top plate.

5. The apparatus in accordance with claim 1, and said mounting means being adapted to removably support a fulling plate blank as a work piece after a top plate with an aperture has been removed;

said forming means contouring the periphery of a fulling plate blank to form a fulling plate; and a fourth feeler means arranged to move along a contoured periphery of the outer portion of a bottom plate and being connected to guide said forming means when contouring the periphery of a fulling plate blank.

6. The apparatus in accordance with claim 5, and each of said feeler means when in use being mounted coaxially with and spaced axially from said forming means a distance equal to the distance between a work piece and a plate providing the periphery along which said feeler means moves.

* * * * *